US006878123B2

(12) United States Patent
Bassuk et al.

(10) Patent No.: US 6,878,123 B2
(45) Date of Patent: Apr. 12, 2005

(54) COMBINED HORIZONTAL AND VERTICAL CPR DEVICE

(76) Inventors: Jorge I. Bassuk, 1638 S. Bayshore Ct., Coconut Grove, FL (US) 33133; Jose A. Adams, 780 Lake Rd., Miami, FL (US) 33140

( * ) Notice: Subject to any disclaimer, the term of this patent is extended or adjusted under 35 U.S.C. 154(b) by 429 days.

(21) Appl. No.: 10/051,780

(22) Filed: Jan. 16, 2002

(65) Prior Publication Data

US 2003/0135085 A1 Jul. 17, 2003

(51) Int. Cl.[7] ..... A61H 31/00
(52) U.S. Cl. ..... 601/41; 601/98; 601/101
(58) Field of Search ..... 601/41, 42, 43, 601/97, 98, 101, 23, 24, 26

(56) References Cited

U.S. PATENT DOCUMENTS 2,062,300 A * 12/1936 Erickson ..... 601/33
2,241,480 A * 5/1941 Sanders ..... 601/98
2,243,013 A * 5/1941 Morey et al. ..... 601/101
2,889,826 A * 6/1959 Russo ..... 601/117
3,254,645 A * 6/1966 Rand et al. ..... 601/97
3,455,297 A * 7/1969 Russell ..... 601/98
3,552,390 A * 1/1971 Muller ..... 601/97
4,875,470 A * 10/1989 Cotone ..... 601/117
5,520,614 A * 5/1996 McNamara et al. ..... 601/24
6,155,976 A 12/2000 Sackner et al.

* cited by examiner

*Primary Examiner*—Danton DeMille
(74) *Attorney, Agent, or Firm*—McHale & Slavin PA

(57) ABSTRACT

A combination CPR device supports a supine victim on a movable platform that carries an external heart massager. The platform moves in the cephalo-caudal direction with the external heart massager above the sternum. The external heart massager moves in the anterior-posterior direction. The movement of the platform and the external heart massager is conducted simultaneously and may be coordinated manually or by a controller.

4 Claims, 2 Drawing Sheets

COMBINED HORIZONTAL AND VERTICAL CPR DEVICE

FIELD OF THE INVENTION

This invention relates to the field of cardio-pulmonary resuscitation (CPR) and a device for assisting in the performance of the procedure.

BACKGROUND OF THE INVENTION

CPR has been taught to numerous emergency medical personnel (EMP) and others as a procedure for external heart massage and forced ventilation for use with heart attack victims. This conventional technique provides partial blood pressure, simulating a heart beat, and oxygen rich forced inhalation to the lungs. In a situation where no medical equipment is present, the procedure requires the EMP to place his hands on the sternum of a supine victim and compress the chest cavity of the victims by a quick downward stroke. This stroke is repeated to approximate the frequency of a regular heart beat. After several strokes, the victim's airway is cleared and a volume of air is forced into the lungs by blowing air from the EMP's mouth into the mouth of the victim. This is continued until more sophisticated help and equipment arrives.

There are several conventional machines that mechanically re-create the sequence described above. The major advantages of the machines is a regularity of the simulated heartbeat and a larger volume of uncontaminated oxygen rich air synchronized with each other. One such machine is portable and has a small compressed air tank which powers a small piston, strapped to the victims chest, and a breathing mask placed over the victim's mouth. Once the device is in place the EMP must monitor the operation until it is completed.

There are other methods of increasing the cardiac support and volume of air inhaled by a weakened victim. One of these devices is taught by U.S. Pat. No. 6,155,976 which discloses an oscillation table for carrying a supine victim and moves horizontally along the long axis through displacement modules controlled by computer. The device has several monitors and may be used as a trigger for other CPR support.

What is needed in the art is device to simultaneously apply oscillation to the victim along with CPR procedures to improve the outcome of the CPR over that produced by manual or mechanical or oscillation CPR, alone.

OBJECTS OF THE INVENTION

Accordingly, it is an object of this invention to provide an oscillation table with integrated facilities for external heart massage and ventilation.

It is another object of the invention to provide for manual CPR procedure during oscillation of the victim.

It is still another object of the invention to provide for mechanical CPR during oscillation of the victim.

It is yet another object of the invention to provide coordination and synchronization between the oscillations of the table and the CPR manipulations.

Other objects and modifications will become apparent from the description of the invention.

DETAILED DESCRIPTION OF THE DRAWINGS

Figure 1:
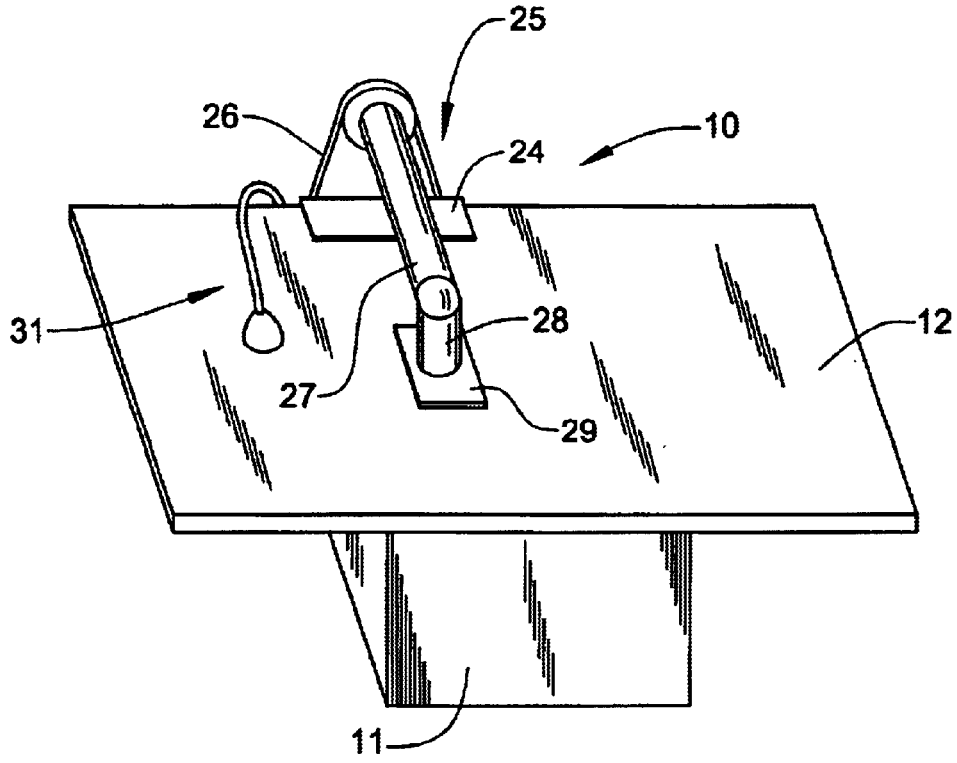
FIG. 1 is a perspective of the oscillation table and CPR device.
Figure 2:
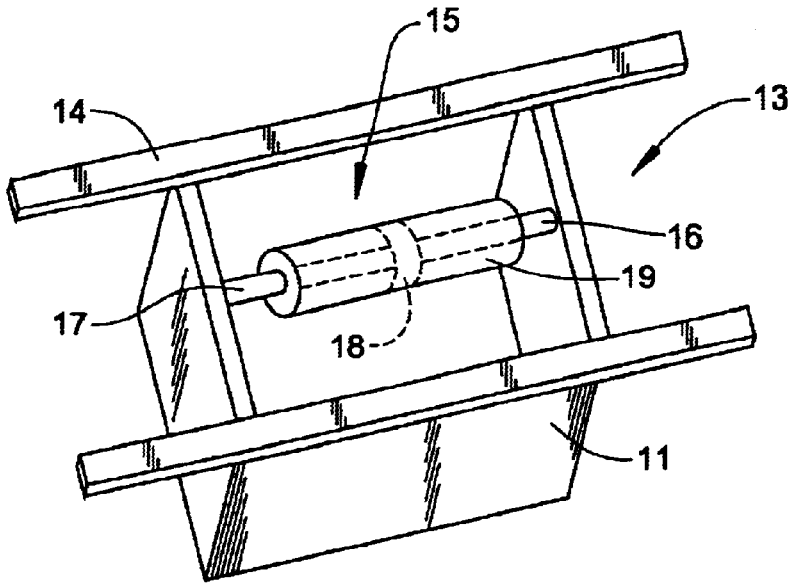
FIG. 2 is a top plan view of the oscillation table showing one embodiment of the motive force for oscillation.

In FIG. 1, the oscillation table 10 is shown mounted on a pedestal 11 having pistons having a platform 12 which oscillates to move in the lengthwise direction to and fro. When the victim is lying supine on the platform 12, the direction of movement is in the cephalo-caudal direction or parallel to the spine. The platform 12 supports the spine of the victim so that the chest cavity may be depressed during CPR. The platform 12 is mounted on a framework 13, in the from of rails 14, movably supported by the pedestal 11. The a oscillation source 15 is placed between the rails 14 and connected to them for the reciprocating movement, as well as, the motive force for the table 10. In FIG. 2, the framework is connected to one end of opposing piston rods 16 and 17. The other ends of the opposing piston rods are attached to a double acting piston 18 housed within cylinder 19 fixedly mounted in the pedestal 11.

Figure 3:
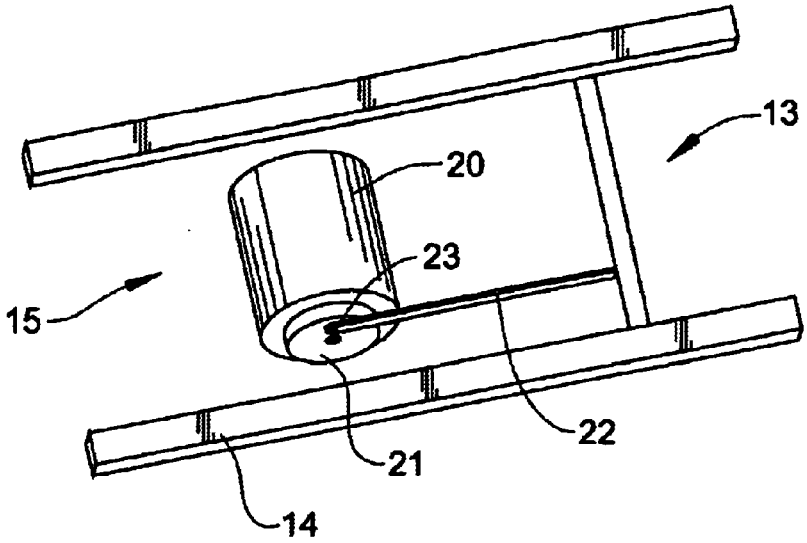
FIG. 3 is a top plan view of another embodiment of the motive force for oscillation.
Figure 4:
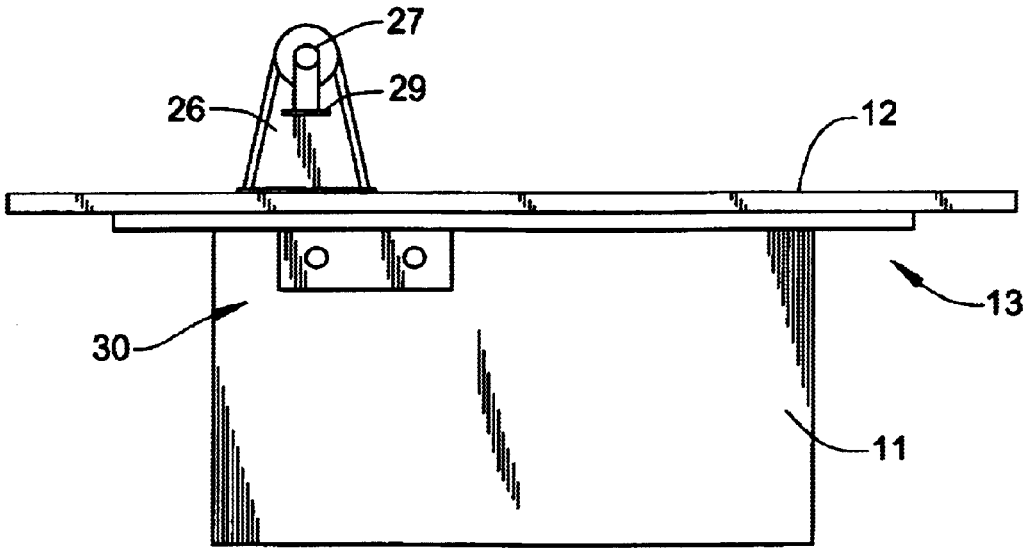
FIG. 4 is a side view of the oscillation table and CPR device, partially in schematic.

In FIG. 3, another embodiment of the oscillation source 15 is shown as an electric motor 20 connected, directly or through gears, to a flywheel 21. The flywheel 21 has a rod 22 with one end eccentrically connected by wrist pin 23 and the other end connected to the framework 13.

FIGS. 2 and 3 are examples of mechanisms for creating oscillation in the table 10. Other designs, such as opposing pistons at each end of the table, are included as matters of choice. The operation of the piston rods may be by a electrical, mechanical, pneumatic, or hydraulic source of power.

The platform 12 may be mounted on legs attached to each corner with casters movably supporting the platform on the floor for oscillatory movement (not shown). In this modification, the table 10 includes a headboard and a footboard carrying pistons.

The table 10 may have the capability of vibratory movement (not shown) in the anterior-posterior direction as a component of the oscillatory movement of the victim. The movement of the table 10 appears to create a massage of the internal organs, including the heart and lungs, within the musculo-skeletal body by the abrupt change in direction of movement of the victim's body. In addition, there may be certain physical reflex actions stimulated by the movement that contribute to the victim's resuscitation. The oscillations of the platform may be repeated to approximate the normal breathing cycle of inhalation and exhalation or the oscillations may be manually controlled.

Platform 12 includes a mounting 24 for connecting a mechanical CPR device 25. The mounting 24 may form a permanent connection between the platform and the vertical support 26 or it may be a removable connection. The vertical support 26 has a horizontal arm 27 which is parallel with the surface of the platform 12. The horizontal arm 27 may be rotated about the support 26 to be placed above the sternum of a supine victim. The horizontal arm 27 terminates with a cylinder 28. Within cylinder 28 is a reciprocating piston carrying a pad 29 which contacts the victim and depresses the chest cavity as the piston repeatedly moves in the anterior-posterior direction. The piston may repeat each stroke in a sequence that approximates a normal heartbeat or it may be manually controlled. Piston may have the same source of power as the oscillation source 15 or it may be independently powered. Further, the piston may be located in the vertical support 26 with the cylinder 28 being solid.

The pad 29 may be of such a size and material to prevent trauma to the sternum and ribs of the victim.

A controller 30 is connected to the table 10, oscillation source 15 and the CPR device 25 to regulate, coordinate and synchronize the oscillations of the table and the strokes of the CPR device to maximize the efficiency and effectiveness of the combined procedures in resuscitation of the victim. As mentioned above, the controller 30 may have a manual mode for independent control of each component. The controller may be mechanical, electrical or electronic. In another embodiment, the controller may be omitted.

In the event that manual CPR is continued after the victim is placed on the table 10, the platform 13 may accommodate the person giving the manual CPR. The person may occupy the space of the mounting 24. In another embodiment (not shown), the person may be supported on a small movable stage connected to the platform and depending from the rails. Alternately, the person could remain stationary and give a depressing stroke when the victim's sternum is located under his hands.

The table 10 may also be equipped with a ventilating device 31, in the form of a face mask or tracheal tube for forcing oxygen or compressed air into the lungs of the victim. The cylinders of gas may be stored in the pedestal 11. The ventilating device 31 may be operated through the controller 30 to synchronize the inhalation with the oscillations and CPR strokes.

We claim:

1. A table for providing cardio-pulmonary resuscitation comprising a framework supporting a movable platform, said platform adapted to support a supine victim and movable in the cephalo-caudal direction, said framework including a means for repetitive oscillations of said platform to and fro, a CPR means connected to said platform, said CPR means adapted to contact the sternum of said victim and adapted to move in a anterior-posterior direction to compress the chest cavity of said victim, said CPR means having repetitive movement whereby said victim is subjected to abrupt changes in direction and external heart massage simultaneously further comprising a mounting on said platform, said CPR means having a vertical support connected at one end to said mounting, said vertical support connected at the other end to a movable pad, said pad adapted to contact the sternum of said victim.

2. A table for providing cardio-pulmonary resuscitation, as claimed in claim 1, further comprising a control means operatively connected to said means for repetitive oscillations and said means for repetitive movement of said pad for synchronizing and coordinating said repetitive oscillations and said repetitive movement of said pad for effective and efficient resuscitation of said victim.

3. A table for providing cardio-pulmonary resuscitation, as claimed in claim 1, further comprising a means adapted for ventilating said victim with oxygen rich compressed gas.

4. A table for providing cardio-pulmonary resuscitation, as claimed in claim 2, further comprising a means adapted for ventilation said victim operatively connected to said control means for synchronizing and coordinating ventilation with said repetitive oscillations and said repetitive movement of said pad.

* * * * *